US008955466B2

(12) United States Patent
Harrison

(10) Patent No.: US 8,955,466 B2
(45) Date of Patent: Feb. 17, 2015

(54) HEAT RECOVERY SYSTEM AND METHOD

(75) Inventor: Rupert Mark Harrison, W. Sussex (GB)

(73) Assignee: Doosan Babcock Energy America, Atlanta, GA (US)

( * ) Notice: Subject to any disclaimer, the term of this patent is extended or adjusted under 35 U.S.C. 154(b) by 1517 days.

(21) Appl. No.: 12/393,556

(22) Filed: Feb. 26, 2009

(65) Prior Publication Data

US 2010/0212610 A1 Aug. 26, 2010

(51) Int. Cl.
*F23L 15/00* (2006.01)
*F22D 1/36* (2006.01)
*F22D 1/40* (2006.01)

(52) U.S. Cl.
CPC ... *F22D 1/36* (2013.01); *F22D 1/40* (2013.01)
USPC ..... 122/1 A; 122/7 R; 122/412; 122/421

(58) Field of Classification Search
USPC ..... 122/1 A, 7 R, 412, 414, 415, 421; 165/8–10
See application file for complete search history.

(56) References Cited

U.S. PATENT DOCUMENTS 4,037,567 A * 7/1977 Torres ..... 122/20 B
4,582,122 A 4/1986 Fan
4,738,226 A * 4/1988 Kashiwazaki et al. ..... 122/480
5,247,907 A * 9/1993 Lee et al. ..... 122/1 R
6,598,399 B2 * 7/2003 Liebig ..... 60/772
6,748,880 B2 * 6/2004 DeSellem ..... 110/345
7,021,248 B2 * 4/2006 McNertney et al. ..... 122/7 R
2008/0142608 A1 6/2008 Krogmann

FOREIGN PATENT DOCUMENTS

DE 4441324 11/1994
DE 9420492 11/1994
DE 4431 156 A1 3/1996
GB 841040 7/1960
WO WO 95/24822 9/1995
WO WO 2004/027221 A1 4/2004

* cited by examiner

*Primary Examiner* — Kevin Murphy

(57) ABSTRACT

A system providing for heat recovery from exhausted flue gas in a steam generator is described comprising a flue gas outlet conduit defining a flow path for flue gas from a flue gas outlet of a steam generator to a flue gas conduit junction point; a flue gas primary conduit defining a flow path for flue gas from the junction to a primary air preheater; a flue gas secondary conduit defining a flow path for flue gas from the junction to a secondary air preheater; wherein a steam generator process fluid heat exchanger is disposed within the flow path of the flue gas primary conduit upstream of the primary air preheater to recover some heat from the flue gas in advance of the primary air preheater. A method implementing the flow principles embodied in such a system is also described.

22 Claims, 2 Drawing Sheets

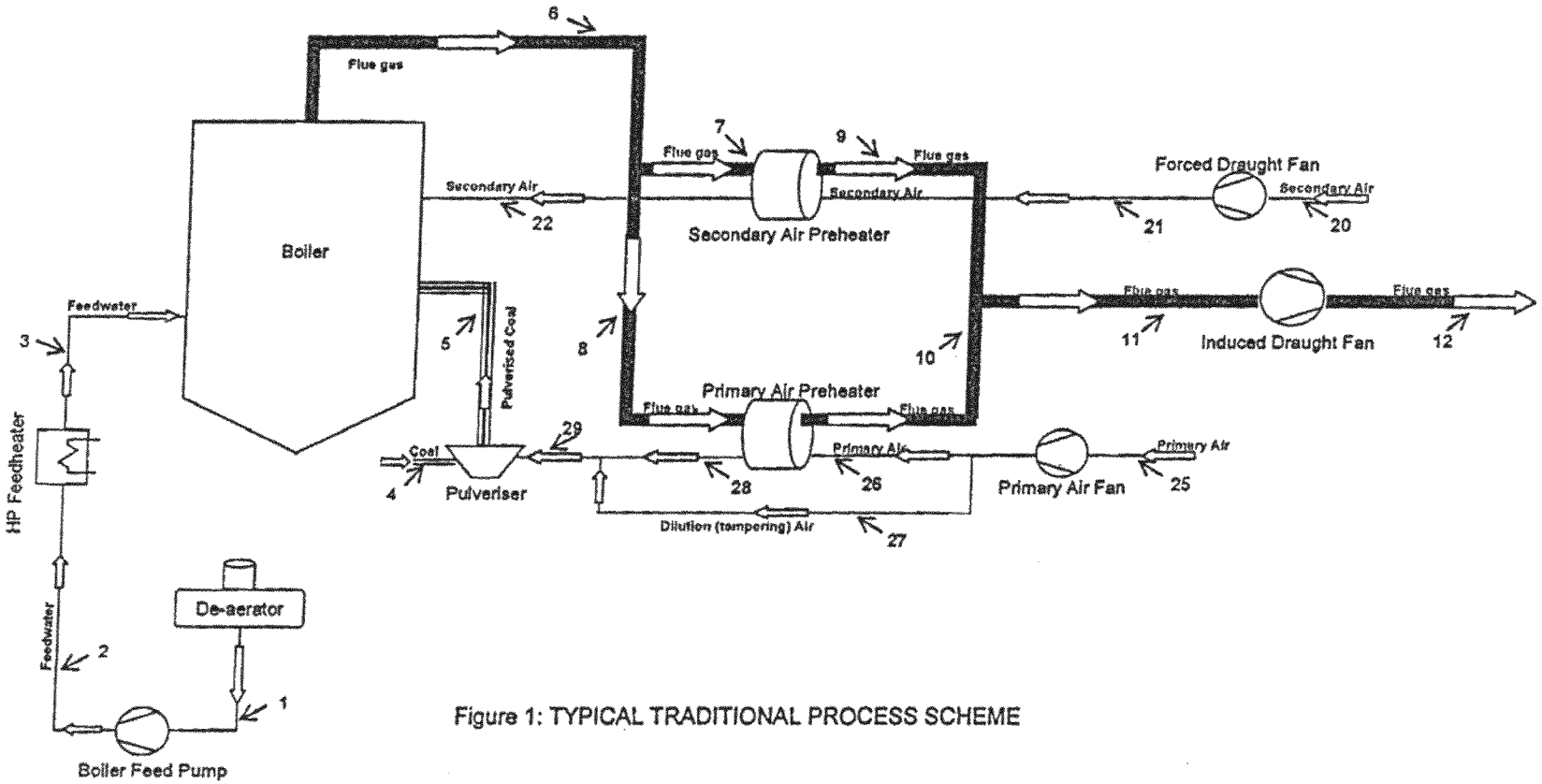
Figure 1: TYPICAL TRADITIONAL PROCESS SCHEME
PRIOR ART

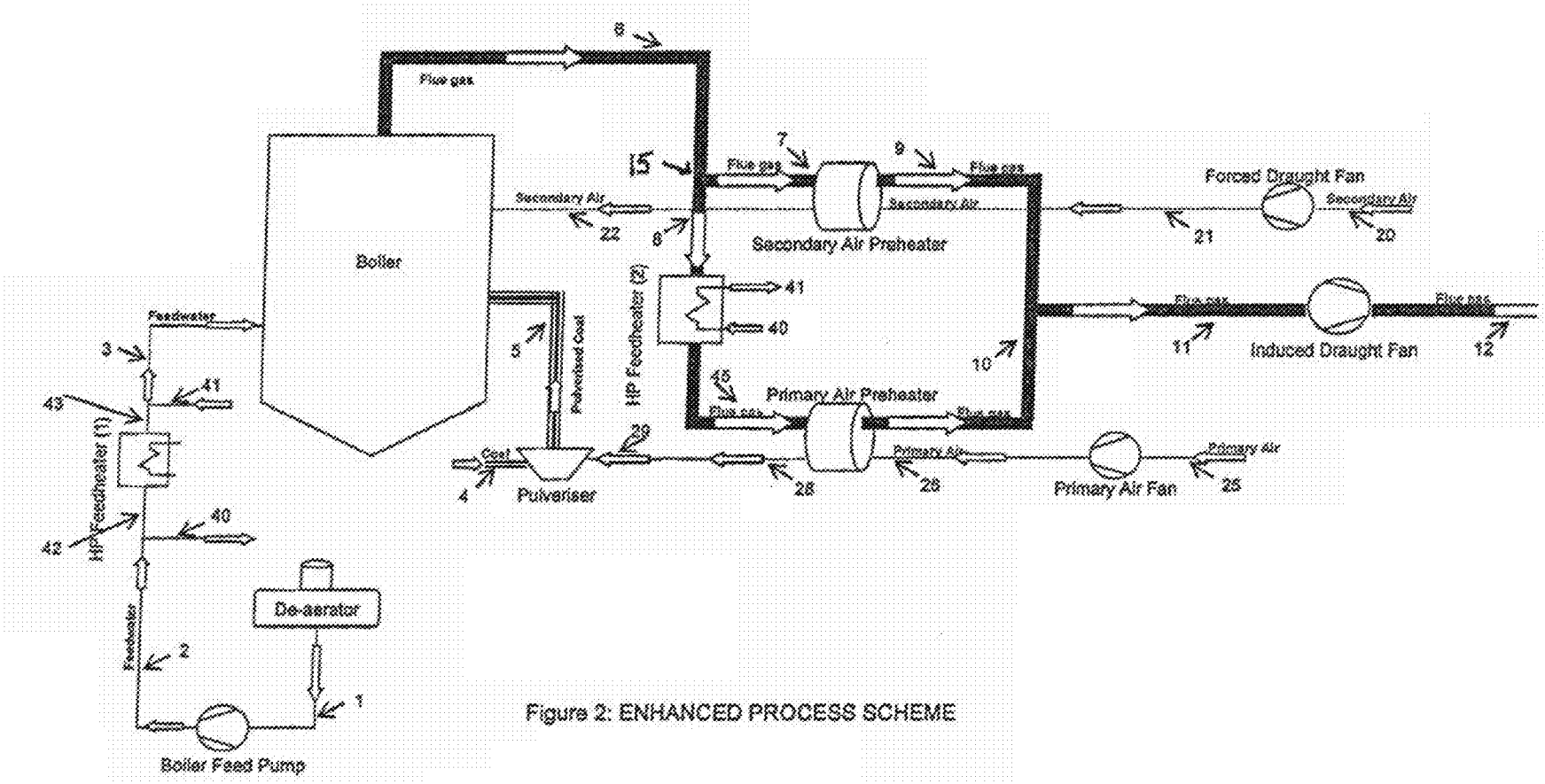
Figure 2: ENHANCED PROCESS SCHEME

HEAT RECOVERY SYSTEM AND METHOD

This invention relates to a method of control applied to a coal fired steam generator (boiler) which forms part of a power plant using steam driven turbine generators and a condensate and feed heating (heat recovery) system and to a system controlled in accordance with the principles of the method.

FIG. 1 shows a typical existing process scheme.

The air for the boiler combustion process relies on the exhausted flue gas from the boiler, exiting the economiser, to provide heating for combustion (secondary) air and coal pulveriser (primary) air requirements by use of regenerative air heaters.

The feed water for the boiler relies on bled steam derived from the steam turbines to supply HP feed heaters such as to heat the feed water to the required inlet temperature for the boiler.

With the demand for higher boiler exit flue gas temperatures, the air temperature generated for the coal pulveriser (primary) air is much greater than that required by the coal pulveriser. A diluting cold air (tempering air) is used to reduce the coal pulveriser (primary) air temperature. This is an inefficient way of using energy.

According to the invention in a first aspect, a system providing for heat recovery from exhausted flue gas in a steam generator comprises flow path defining means for flue gas exhausted from a steam generator comprising:

- a flue gas outlet conduit defining a flow path for flue gas from a flue gas outlet of a steam generator to a flue gas conduit junction point;
- a flue gas primary conduit defining a flow path for flue gas from the junction to a primary air preheater;
- a flue gas secondary conduit defining a flow path for flue gas from the junction to a secondary air preheater;
- wherein a steam generator process fluid heat exchanger is disposed within the flow path of the flue gas primary conduit upstream of the primary air preheater to recover some heat from the flue gas in advance of the primary air preheater.

In accordance with the apparatus of the invention, a flue gas stream is exhausted from the steam generator, for example including an economiser in familiar manner, through the outlet conduit, for example drawn by suitable impellers. The flue gas is conveyed to a junction point where the outlet conduit splits into two streams, a primary and a secondary stream, for example by means of proportioning dampers. At this point, a part of the exhausted flue gas passes via the primary stream and a part via the secondary stream. The primary flue gas stream passes to a primary, coal pulveriser air preheater and the secondary flue gas stream to a secondary, combustion air preheater in familiar manner.

The temperature requirements for the primary and secondary air are different. Exhaust temperatures are often too high for the temperature required of the primary air. Conventionally, a diluting cold air supply is used to reduce the primary air temperature downstream of the primary air preheater. Instead, in accordance with the invention, heat exchanger adapted to transfer heat from flue gas to a process fluid, for example a process fluid preheater, is provided upstream of the primary air preheater to remove some of the heat from the flue gas and hence reduce the subsequent primary air temperature.

The secondary flue gas stream can still be at the high exhaust temperature typical of a modern steam generation system, but the primary flue gas stream is cooled, and some heat recovered, before it reaches the primary air preheater. Thus, the operation is generally more efficient in its recovery of heat, and reduces, and in an ideal case eliminates in normal operation, the need for tempering air.

Preferably, the system therefore has no tempering air source supply into the primary air stream.

The process fluid may for example be feed water, in which case the process fluid preheater comprises a feed water preheater such as a high pressure water preheater. The water preheater preheats the feed water and recovers some heat from the primary exhaust stream.

Application of a flue gas to a process fluid heat exchanger upstream of the primary air regenerative air heater, to provide partial HP feed-heating reduces the flue gas temperature to a reasonable temperature for the pulveriser regenerative air heater to meet the coal pulveriser primary air requirements without the need for dilution air.

The HP feed-heating is normally controlled by using turbine bled steam from different stages of the turbine. The application of this heat exchanger reduces the turbine bled steam demand.

The use of the exhaust gas heat to provide partial HP feed heating improves the overall efficiency of the power plant and reduces the use of cold air into the system.

The process fluid preheater is for example a secondary feed water preheater supplementing a conventional high pressure preheater in the feed water flow stream. The secondary preheater may be provided in series up or downstream of or in parallel to the primary feed water preheater.

In accordance with the invention in a more complete aspect there is provided a steam generation system comprising a steam generator such as a boiler and a flue gas heat recovery system as above described.

In a further aspect of the invention there is provided a heat recovery method for recovering heat from exhaust flue gases of a steam generator comprising the following steps:

- dividing flue gas exhausted from a steam generator into two streams;
- causing a first stream to feed into a primary air preheater;
- causing a second stream to feed into a secondary air preheater;
- wherein the stream feeding into a primary air preheater is first cooled by heat exchange with a steam generator process fluid stream, such as a feed water stream.

Conveniently, the two streams are created by conveying exhaust flue gas along a flow path defining means comprising an outlet conduit, and a junction defining separate primary and secondary flue gas conduits downstream of the outlet conduit. Preferably, the streams are divided using proportioning dampers. Conveniently, heat exchange with a process fluid is effected in a heat exchanger such as an economiser. The process fluid may be feed water.

In accordance with a further aspect of the invention there is provided a method of modification of a heat recovery system for a steam generator having a primary flue gas exhaust stream supplying a primary preheater and a secondary flue gas exhaust stream supplying a secondary preheater, the method comprising providing a heat exchanger in the primary flue gas exhaust stream upstream of the primary air preheater to cool primary air by heat exchange with a steam generator process fluid such as steam generator feed water.

The invention will now be described by way of example only with reference to FIGS. 1 and 2 of the accompanying drawings in which:

FIG. 1 illustrates a typical conventional process stream in which exhaust flue gasses are used to supply a primary and secondary air preheater;

FIG. 2 illustrates a process scheme in accordance with an embodiment of the invention.

The primary air, via connection 25, is sucked in by the primary air (PA) fan which discharges the primary air, via connection 26, to the primary air preheater. The hot primary air is then fed by connection 28 to the coal pulveriser. The high flue gas temperatures achieved in many contemporary steam generators are such as to exceed that required for the primary air. To accommodate this the hot air is diluted by colder air delivered via connection 27 to achieve the required hot air temperature for the coal pulveriser. Pulverised coal is added via connection 4 to the pulveriser and the pulverised coal in a cooled air mixture is fed the boiler for combustion via connection 5.

The rest of the combustion air, called secondary air, supplied via connection 20, is sucked in by the forced draught (FD) fan, which discharges the secondary air, via connection 21, to the secondary air preheater. The hot air is fed, via connection 22, to the boiler for combustion via connection 22.

The feed water to the boiler is derived from the de-aerator, via connection 1, and driven by a boiler feed pump to the HP feed heaters, via connection 2.

Bled steam derived from the steam turbines is used to heat the feed water to the required inlet temperature for the boiler, entering the economiser. The hot feed water is routed to the boiler via connection 3.

The combustion process produces exhaust flue gas, which is reduced in temperature within the boiler to produce steam, before exiting the economiser via connection 6 which defines an initial flow path conduit.

The flue gas is fed to the secondary and primary air preheaters, via connections 7 and 8 which respectively define secondary and primary flue gas flow path conduits. Heat is recovered in the preheaters to heat the primary and secondary air streams. The colder flue gas is then combined via connections 9 and 10 respectively to form connection 11.

It is then fed via the induced draught fan to the exhaust stack or any emissions equipment present.

Although such an arrangement recovers some of the heat residual in the flue gas, the effect of the tempering air supply 26 being fed into the primary air stream, as necessitated in case that the air temperature for the primary air needs to be much less than the boiler exit flue gas temperature, reduces the efficiency of energy recovery.

The present invention refers to the enhancement to the above process which is shown in FIG. 2. Components in common with the conventional arrangement of FIG. 1 are illustrated by common reference numerals.

The primary air, via connection 25, is sucked in by the primary air (PA) fan which discharges the primary air, via connection 26, to the primary air preheater. The hot primary air is then fed by connection 28 and 29 to the coal pulveriser. This hot air is no longer diluted by colder air, delivered via connection 27, and the dilution line connection 27 is deleted. The coal is added via connection 4 to the pulveriser and the pulverised coal in a cooled air mixture is fed the boiler for combustion via connection 5.

The rest of the combustion air called secondary air, via connection 20, is sucked in by the forced draught (FD) fan, which discharges the secondary air, via connection 21, to the secondary air preheater. The hot air is fed, via connection 22, to the boiler for combustion via connection 22.

The feed water to the boiler is derived from the de-aerator, via connection 1, and driven by a boiler feed pump towards the HP feed heaters, via connection 2. The feed water is then divided, with the majority of feed flow going via connection 42, to HP feed heater (1). Bled steam derived from the steam turbines is used to heat this feed water to the required inlet temperature for the boiler.

The rest of the feed flow is routed, via connection 40 to the HP feed heater (2), flue gas to feed water heat exchanger (economiser) where the flue gas is used to heat this feed water to the required inlet temperature for the boiler.

The heated water from both sources is recombined via connections 43 and 41 respectively, before entering the economiser. The hot feed water is routed to the boiler via connection 3

The combustion process produces exhaust flue gas, which is reduced in temperature within the boiler to produce steam, before exiting the economiser via connection 6.

The flue gas leaving the boiler is divided into two streams using proportioning dampers 15.

One stream heats the secondary air and the other heats the primary air.

The gas stream that heats the secondary air (via secondary flue gas conduit 7) is cooled within the secondary air preheaters to provide secondary air heating. The colder flue gas is then fed via connection 9 to the common connector 11.

The gas stream that heats the primary air (via primary flue gas conduit 8) is cooled by exchange of heat to a HP feed water (2) (could be any other suitable process fluid, as may be applicable) to such a temperature that on entering the primary air heater, it effects heating of the primary air to such a temperature that it requires no additional cooling by dilution air before the primary air enters the mills. The colder flue gas is then fed via connection 10 to the common connector 11.

It is then fed via the induced draught fan to the exhaust stack, via connection 12 or any emissions equipment present.

Because there is no requirement for dilution air to cool the primary air leaving the preheater, more useful heat can be extracted from the flue gas before it is discharged to atmosphere and thereby the efficiency of the plant is increased.

What is claimed is:

1. A system providing for heat recovery from exhausted flue gas in a pulverised coal fired steam generator comprising:

a flue gas outlet conduit defining a flow path for flue gas from a flue gas outlet of a steam generator to a flue gas conduit junction point whereat the outlet conduit splits into a primary flow path and a secondary flow path;

a flue gas primary conduit defining a flow path for flue gas from the junction to a primary, coal pulveriser air preheater, a flue gas secondary conduit defining a flow path for flue gas from the junction to a secondary, combustion air preheater;

wherein a steam generator process fluid heat exchanger is disposed within the flow path of the flue gas primary conduit upstream of the primary air preheater to recover some heat from the flue gas and to cool the primary flue gas stream in advance of the primary air preheater; and wherein there is no tempering air source supply into the primary air stream.

2. A system in accordance with claim 1 wherein the steam generator incorporates an economizer upstream of the flue gas outlet.

3. A system in accordance with claim 1 wherein the flue gas conduit junction point comprises a set of proportioning dampers to divide the flue gas in use into a primary stream and a secondary stream.

4. A system in accordance with claim 1 further comprising a suitable impeller to draw flue gas in use through the flue gas outlet conduit, flue gas primary conduit, and flue gas secondary conduit.

5. A system in accordance with claim 1 wherein the process fluid is feed water and the process fluid heat exchanger comprises a feed water preheater.

6. A system in accordance with claim 5 wherein the process fluid heat exchanger comprises a high pressure water preheater.

7. A system in accordance with claim 6 wherein the process fluid preheater is a secondary feed water preheater supplementing a conventional high pressure preheater in the feed water flow stream.

8. A system in accordance with claim 7 wherein the secondary preheater is provided fluidly in parallel to the primary feed water preheater.

9. A steam generation system comprising a pulverized coal fired boiler and a flue gas heat recovery system in accordance with any preceding claim.

10. A heat recovery method for recovering heat from exhaust flue gases of a pulverised coal fired steam generator comprising the following steps:

dividing flue gas exhausted from a steam generator into two streams;

causing a first stream to feed into a primary, coal pulveriser air preheater;

causing a second stream to feed into a secondary, combustion air preheater;

wherein the flue gas stream feeding into a primary air preheater is first cooled by heat exchange with a steam generator process fluid stream; and wherein there is provided no tempering air source supply into the primary air stream.

11. A method in accordance with claim 10 wherein the process fluid is feed water and the flue gas stream feeding into a primary air preheater is first cooled by heat exchange with a feed water stream.

12. A method in accordance with claim 10 wherein the two streams are created by conveying exhaust flue gas along a flue gas flow path defining means comprising an outlet conduit, and a junction defining separate primary and secondary flue gas conduits downstream of the outlet conduit.

13. A method in accordance with claim 12 wherein the streams are divided using proportioning dampers.

14. A method in accordance with claim 10 wherein heat exchange with a process fluid is effected in a heat exchanger.

15. A method in accordance with claim 14 wherein the heat exchanger is a process fluid preheater.

16. A method in accordance with claim 15 wherein the process fluid is feed water and the process fluid heat exchanger comprises a feed water preheater.

17. A method in accordance with claim 16 wherein the process fluid preheater is a secondary feed water preheater supplementing a conventional high pressure preheater in the feed water flow stream.

18. A method in accordance with claim 17 wherein the secondary preheater is provided fluidly in parallel to the primary feed water preheater.

19. A method of modification of a heat recovery system for a pulverised coal fired steam generator having a primary flue gas exhaust stream supplying a primary air preheater and a secondary flue gas exhaust stream supplying a secondary, combustion air preheater, the method comprising providing a heat exchanger in the primary flue gas exhaust stream upstream of the primary air preheater to cool primary air by heat exchange with a steam generator process fluid, wherein there is no tempering air source supply into the primary air stream.

20. A method in accordance with claim 19 wherein the process fluid is feed water and the process fluid heat exchanger comprises a feed water preheater.

21. A method in accordance with claim 20 wherein the process fluid preheater is a secondary feed water preheater fitted to supplement a high pressure preheater in the feed water flow stream.

22. A method in accordance with claim 21 wherein the secondary preheater is provided fluidly in parallel to the primary feed water preheater.

* * * * *